US005295942A

United States Patent [19]

Franklin

[11] Patent Number: 5,295,942

[45] Date of Patent: Mar. 22, 1994

[54] FILM ADVANCE MECHANISM

[75] Inventor: Kenneth W. Franklin, Warwickshire, United Kingdom

[73] Assignee: Bishopbarn Limited, United Kingdom

[21] Appl. No.: 979,188

[22] Filed: Nov. 20, 1992

[30] Foreign Application Priority Data

Nov. 23, 1991 [GB] United Kingdom ..... 9124906

[51] Int. Cl.[5] ..... B31C 13/00

[52] U.S. Cl. ..... 493/302; 53/551

[58] Field of Search ..... 493/302; 53/550, 551; 226/170, 180, 179, 189, 192, 172

[56] References Cited

U.S. PATENT DOCUMENTS 5,085,036 2/1992 Evans et al. ..... 493/302

FOREIGN PATENT DOCUMENTS 0759210 10/1956 United Kingdom .

0832635 4/1960 United Kingdom .

*Primary Examiner*—Bruce M. Kisliuk

*Assistant Examiner*—Eileen P. Morgan

*Attorney, Agent, or Firm*—Davis, Bujold & Streck

[57] ABSTRACT

A film advance mechanism is used for advancing a tubular film along a film support with the film surrounding the support. The mechanism comprises two drive units each comprising a drive belt passing round two rollers mounted on a respective drive belt carrier and arranged so that a straight run of the belt can engage frictionally against the film to drive the film along the support. Each carrier is supported for movement towards and away from the film support and for angular movement with respect to the film support and is urged towards the film support such that it aligns itself with the film support due to engagement therewith.

7 Claims, 3 Drawing Sheets

FILM ADVANCE MECHANISM

BACKGROUND TO THE INVENTION

The present invention relates to a film advance mechanism which may form, for example, part of a bag making and filling apparatus for snack foods such as potato crisps.

Known film advance mechanisms involve accurately positioning rubber wheels or the like to bear against opposite sides of a tubular film support over which a tubular film is conveyed. Careful control of the pressure of engagement of the rubber wheels is important because they must grip the film sufficiently to slide it over the film support but must not press it too firmly against the film support to generate excessive friction. The wheels require frequent adjustment to keep them in position and are susceptible to any eccentricities in the bearings, to any misalignment of the support, or a support with non-parallel side walls.

It is an object of the present invention to provide a film advance mechanism which is self-adjusting and able to cope with misalignments.

SUMMARY OF THE INVENTION

According to the present invention there is provided a film advance mechanism for advancing a tubular film along a film support with the film surrounding the support, the mechanism comprising two drive units each comprising a drive belt passing round two rollers mounted on a respective drive belt carrier and arranged so that a straight run of the belt can engage frictionally against the film to drive the film along the support; each carrier being supported for movement towards and away from the film support and for angular movement with respect to the film support and being urged towards the film support such that it aligns itself with the film support due to engagement therewith.

BRIEF DESCRIPTION OF THE DRAWINGS

For a better understanding of the present invention and to show more clearly how it may be carried into effect reference will now be made, by way of example, to the accompanying drawings in which.

DESCRIPTION OF A PREFERRED EMBODIMENT

The drawings show a film advance mechanism which may form, for example, part of a bag making and filling apparatus for snack foods such as potato crisps, or for any other loose product to be sealed in film bags.

Figure 4:
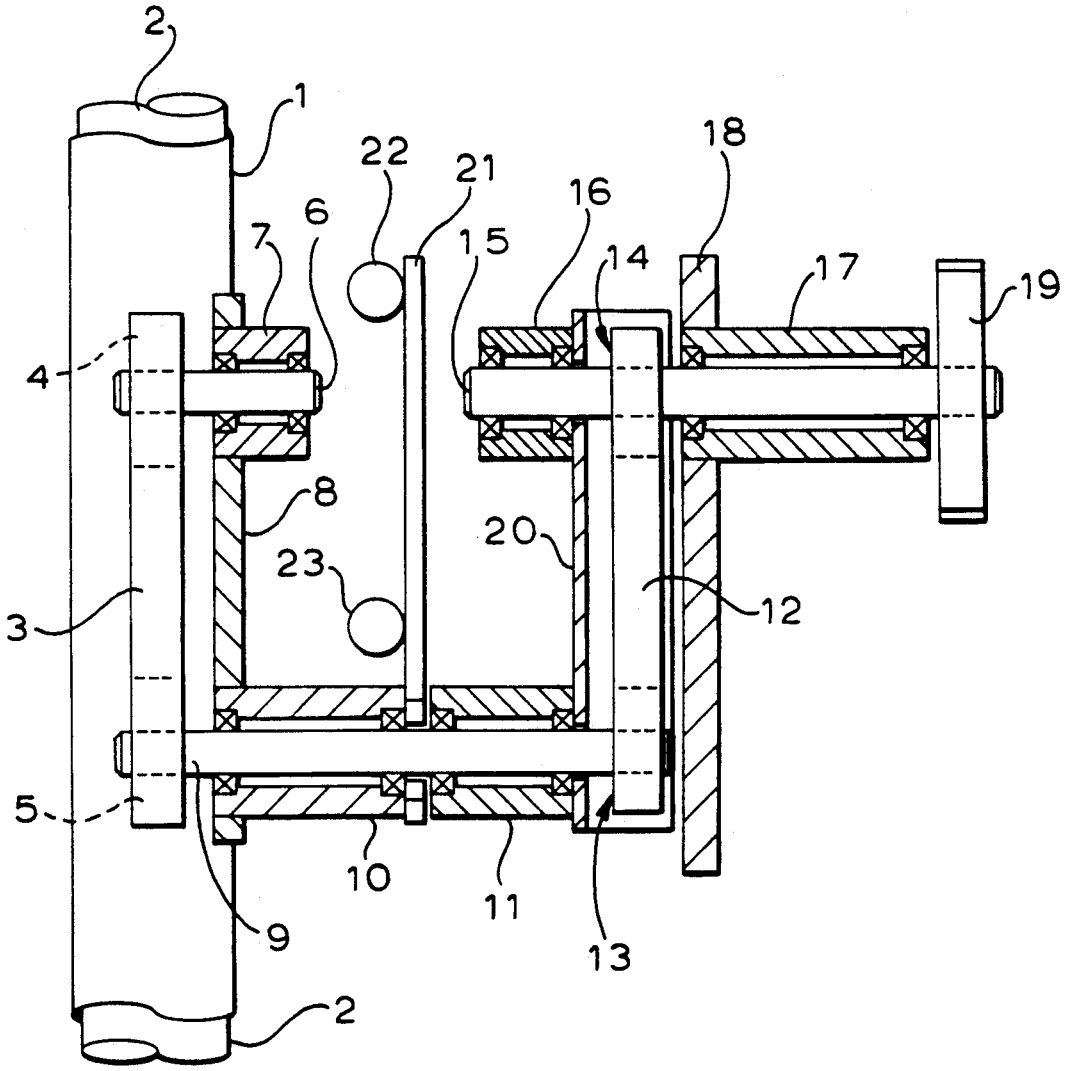
FIG. 4 is a section along the line IV—IV of FIG. 1.

The film advance mechanism serves to advance a tubular film 1 downwardly over the outer surface of a cylindrical tubular film support 2. The film is advanced by means of a pair of grip faced rubber pull down belts 3. Separate drive units associated with each belt are identical so only one will be described. The individual parts of the mechanism are best seen in FIG. 4. Belt 3 is internally toothed, for example, and passes around two rollers 4,5. Upper idle roller 4 is mounted on a shaft 6 which is freely rotatable in a bearing housing 7 provided on a drive belt carrier 8. Lower drive roller 5 is driven by means of a drive shaft 9 rotatably mounted in a bearing housing 10. Bearing housings 7 and 10 are fixed to and form part of the carrier 8.

The other end of drive shaft 9 is rotatably mounted in a further bearing housing 11 carried on and forming part of a swinging arm 20 and is driven by means of an intermediate drive belt 12 (FIG. 4) and a drive roller 13. Intermediate drive belt 12 is internally toothed, for example, and is driven by a drive roller 14 mounted on an input shaft 15 which is rotatably mounted in bearing housing 17. Bearing housing 17 is secured to a main support plate 18 and a main toothed drive pulley 19 which is driven by a belt (not shown). A further bearing housing 16 forming part of swinging arm 20 engages input shaft 15 and provides the pivot for the swinging arm.

Figure 1:
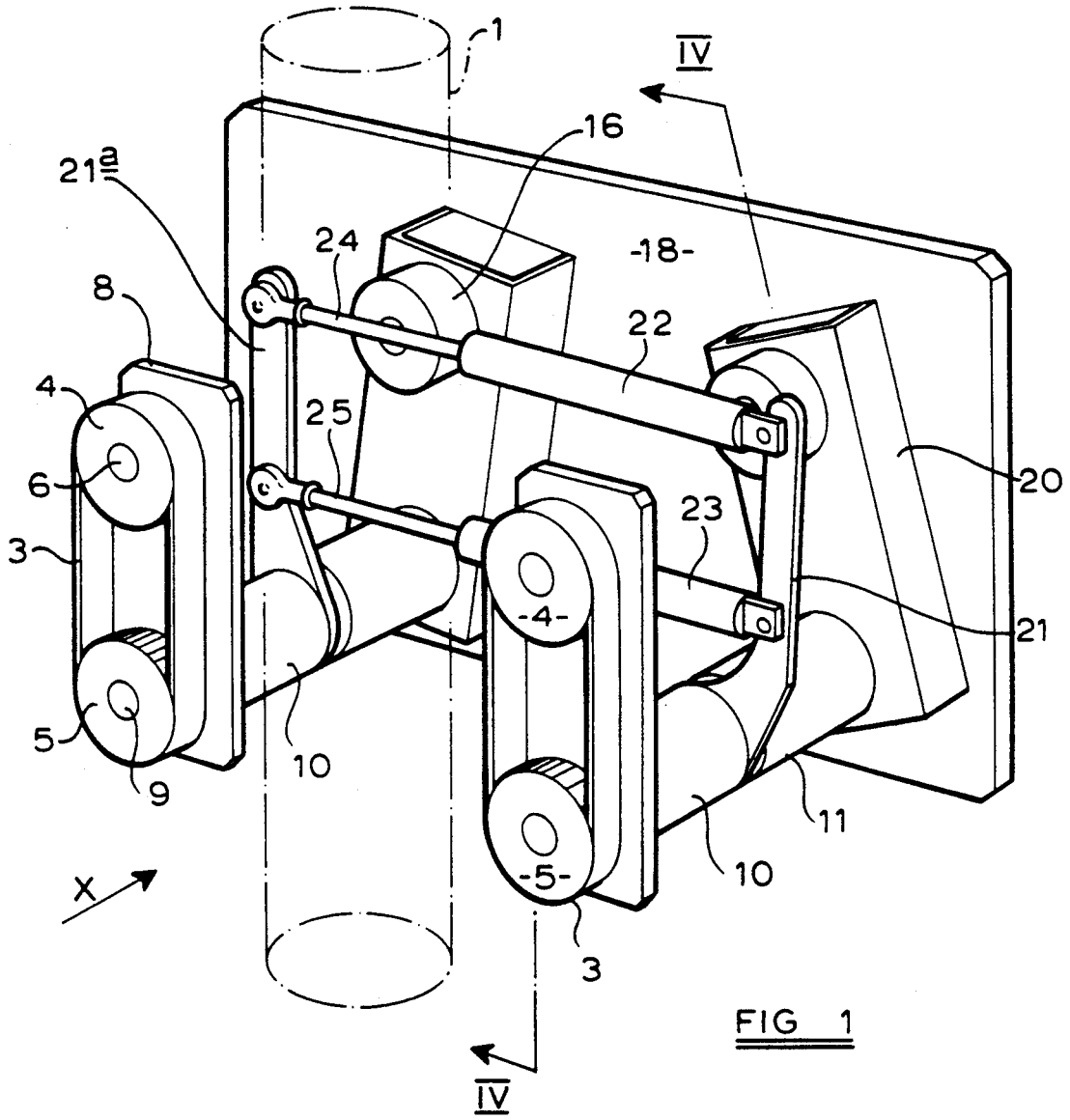
FIG. 1 is a perspective view of one embodiment of a film advance mechanism according to the present invention.

Lever arms 21 and **21*a* (See FIG. 1) are each fixed to a respective bearing housing 10 and thus are fixed to and effectively form part of a respective drive belt carrier 8. Upper and lower biasing means in the form of pneumatic cylinders 22,23 are connected pivotally between the lever arms 21 and 21*a***.

Figure 2:
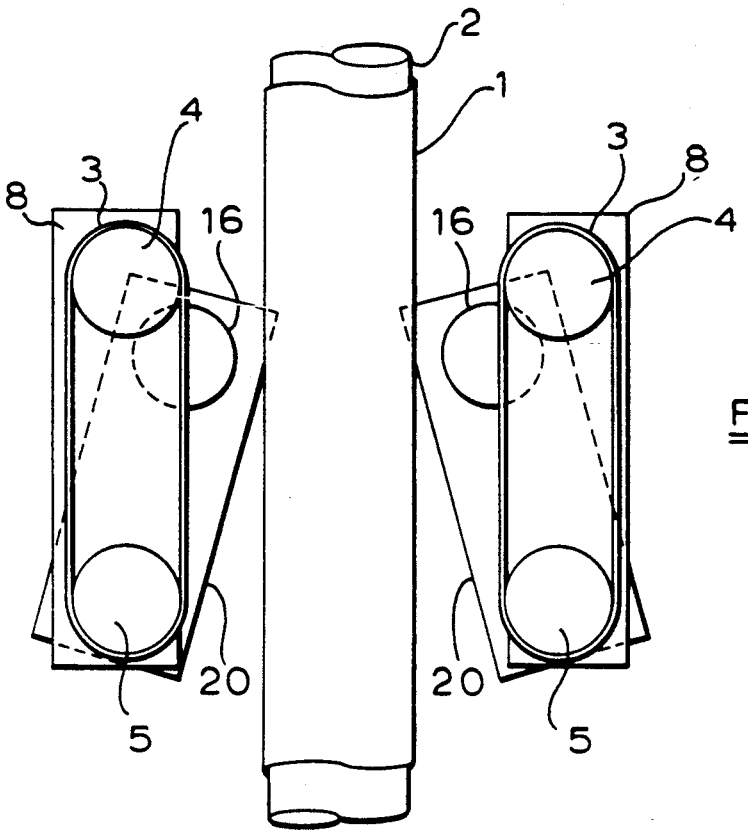
FIG. 2 is an elevation of part of the mechanism shown in FIG. 1 taken in the direction of the arrow X shown in FIG. 1 with the mechanism in an inoperative configuration.
Figure 3:
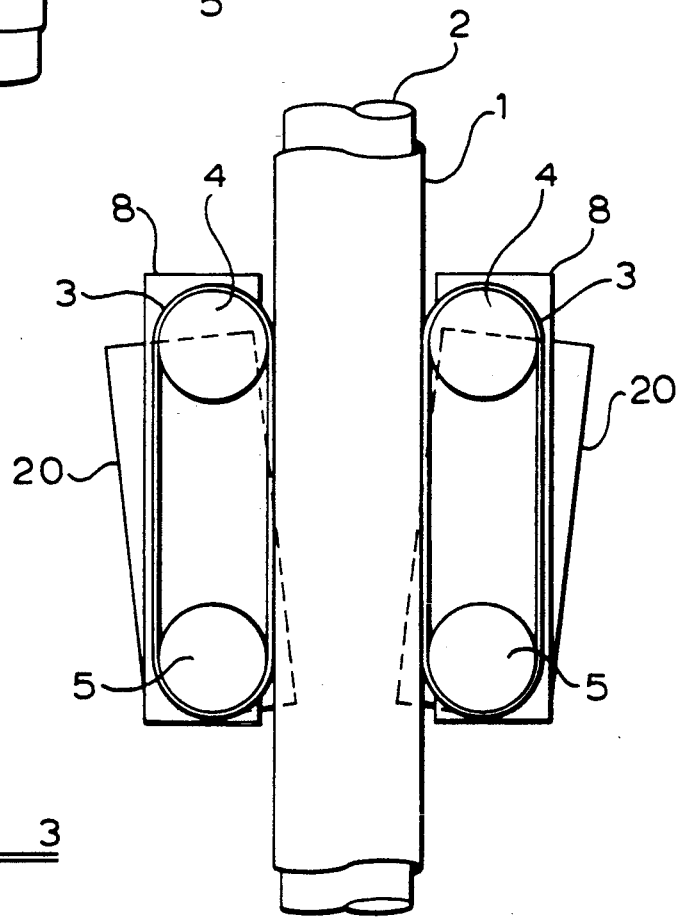
FIG. 3 is a view corresponding to FIG. 2 but in an operative configuration.

In operation, when the cylinders 22,23 are energised to move apart the lever arms **21,21*a*, the carriers 8 with belts 3 are also caused to move apart and swinging arms 20 also swing apart, resulting in the inoperative configuration of the film advance mechanism shown in FIG. 2. Energising of the cylinders to move the belts 3 towards or away from each other can be controlled for example by way of a switch or computer software to facilitate access to the tube and the film for manual advance, threading or the like. When the cylinders 22,23 are energised to move together the lever arms 21, 21*a*, the carriers 8 with belts 3 are caused to move together towards the operative configuration shown in FIG. 3. Because the carriers 8 each have facility for independent pivoting and lateral movement, the belts 3 align themselves against the film support 2 and film 1 under the load applied from the cylinders, with straight runs of the belts engaged frictionally against the film. While the belts are being driven, they cause the film to move down over the film support 2. Because the cylinders 22,23 effectively extend between the two carriers 8, the belts 3** are applied against the film with equal pressures.

The pneumatic cylinders are such as to apply a constant load to the carriers and thus a constant pressure from the belts 3 to the film 1.

This constant pressure is spread relatively evenly over the length of the belt in contact with the film and is maintained during film advance, even when there is any movement of the film support 2 or any variation in the thickness of the belt 3 or any eccentricity of the rollers 4,5 on their bearings. In this way unacceptably high or low pressures can be avoided and a pressure can be chosen which grips the film effectively but allows it to slide over its support. The mechanism described provides an input shaft 15 which is in fixed position relative to the back plate 18 so that it can be driven by any convenient means while the drive belt 3 and its rollers 4, 5 float freely towards and away from the film support 2. The engagement force between the belt 3 and the film and the distribution of this force are not affected by the driving torque applied to the input shaft 15.

Although the mechanism has been described with reference to biasing means in the form of pneumatic cylinders it is possible to use any convenient means to actuate the pivot arms such as hydraulic cylinders or other mechanisms which apply a controlled force.

For easy maintenance, the entire film advance mechanism including its drive means is mounted on a single main back plate or other support base. This facilitates removal of the entire mechanism and also allows the mechanism to be tilted as a whole to adjust the axial alignment of the pull down belts relative to the tracking of the film.

I claim:

1. A film advance mechanism for advancing a tubular film along a film support with the film surrounding the support, the mechanism comprising two drive units; each drive unit comprising a drive belt carrier, two rollers mounted rotatably with respect to the drive belt carrier and a drive belt arranged so that a straight run of the belt can engage frictionally against the film to drive the film along the support; drive means for rotatingly driving at least one of said rollers of each drive unit; support means for each drive belt carrier such that each carrier is supported for movement towards and away from the film support, said support means further allowing for variable angular movement between the straight run of the belt and the film support; and bias means for urging each carrier towards the film support such that each carrier aligns itself with the film support due to engagement therewith.

2. A film advance mechanism as claimed in claim 1, each support means comprising a swinging arm and each drive belt carrier being pivotally mounted on a respective swinging arm.

3. A film advance mechanism as claimed in claim 2 further comprising a common support base, each of said swinging arms being pivotally mounted on said support base.

4. A film advance mechanism as claimed in claim 1 in which the carriers are biased towards the film support by said biasing means being interconnected between the two carriers.

5. A film advance mechanism as claimed in claim 1 wherein the biasing means comprises at least one pneumatic cylinder.

6. A film advance mechanism as claimed in claim 2 wherein the drive means comprises a further drive belt carried by the swinging arm.

7. A film advance mechanism for advancing a tubular film along a film support with the film surrounding the support, the mechanism comprising two drive units; each drive unit comprising a drive belt carrier, two rollers mounted rotatably with respect to the drive belt carrier and a drive belt arranged so that a straight run of the belt can engage frictionally against the film to drive the film along the support; drive means for rotatingly driving at least one of said rollers of each drive unit; support means for each drive belt carrier such that each carrier is supported for movement towards and away from the film support, said support means further allowing for variable angular movement between the straight run of the belt and the film support; and bias means for urging each carrier towards the film support such that each carrier aligns itself with the film support due to engagement therewith; each support means comprising a swinging arm and one end of each drive belt carrier being pivotally mounted on a respective swinging arm providing said angular movement with respect to the film support.

* * * * *